United States Patent [19]

Barto et al.

[11] Patent Number: 4,709,664

[45] Date of Patent: Dec. 1, 1987

[54] METHOD FOR DETERMINING THE EXISTENCE OF PHOSPHATE HIDEOUT

[75] Inventors: Ronald J. Barto, West Hartford; Stephen L. Goodstine, Windsor; Frank A. Noto, East Windsor, all of Conn.

[73] Assignee: Combustion Engineering, Inc., Windsor, Conn.

[21] Appl. No.: 926,058

[22] Filed: Nov. 3, 1986

[51] Int. Cl.[4] ..... F22B 37/18; F22B 37/48

[52] U.S. Cl. ..... 122/379; 210/743

[58] Field of Search ..... 122/379, 382, 397, 398, 122/401, 4 R; 210/743; 364/496

[56] References Cited

U.S. PATENT DOCUMENTS 3,918,469 11/1975 Zamboni et al. ..... 122/379 X 4,453,499 6/1984 Palmer ..... 122/379

*Primary Examiner*—Edward G. Favors

*Attorney, Agent, or Firm*—Arthur E. Fournier, Jr.

[57] ABSTRACT

A method for determining the existence of phosphate hideout in a steam generating steam cycle (10) so that the nature of the impact of the phosphate hideout on pH and the $PO_4$ concentration in the boilerwater of the steam generating steam cycle (10) can be ascertained. The subject method includes the steps of determining from the concentration of $PO_4$ that is provided to the steam generating steam cycle (10) the input of $PO_4$ to the steam generating steam cycle (10), determining the loss of $PO_4$ from the steam generating steam cycle (10) that is attributable to blowdown and contamination and solubility, and thereafter determining as a result of subtracting from the input of $PO_4$ to the steam generating steam cycle (10) the loss of $PO_4$ from the steam generating steam cycle (10) whether there exists phosphate hideout and, if so, what the magnitude of the phosphate hideout is as well as what impact the phosphate hideout will have on the pH of and the $PO_4$ concentration in the boilerwater of the steam generating steam cycle.

15 Claims, 1 Drawing Figure

METHOD FOR DETERMINING THE EXISTENCE OF PHOSPHATE HIDEOUT

CROSS-REFERENCE TO RELATED APPLICATIONS

This application is hereby cross-referenced to the following two patent applications which were commonly filed herewith and which are commonly assigned. U.S. patent application, Ser. No. 926,042, filed Nov. 3, 1986, entitled "Method For Ascertaining Chemical Addition Requirements", filed in the names of Ronald J. Barto, Stephen L. Goodstine and Frank Noto; and U.S. patent application, Ser. No. 925,936 filed Nov. 3, 1986, entitled "Intelligent Chemistry Management System", filed in the names of Ronald J. Barto, Frank Gabrielli and Nancy C. Mohn.

BACKGROUND OF THE INVENTION

This invention relates to steam generation steam cycles, and more specifically to a method for determining the existence of phosphate hideout in a steam generating steam cycle so that the nature of the impact of the phosphate hideout on pH and $PO_4$ concentration in the boilerwater of the steam generating steam cycle can be ascertained.

It has long been a well-known fact in the industry that corrosion in utility steam generators is an area of significant concern to both the manufacturers and users of such equipment. To this end, billions of dollars are reportedly being spent annually in the power generation industry alone in an effort to alleviate problems which are alleged to be caused by corrosion. Significant strides have heretodate been made in attempting to minimize and, in some cases, to eliminate the effects of corrosion. Yet, despite the millions of dollars which to date have been spent for research and development on new materials and on developing operating practices to deal with corrosion and its effects, there are areas in which there still exist a need for improvement.

Reportedly, as high as 50% of the forced outages that are experienced by fossil-fuel steam generators are estimated to be corrosion-related. Such forced outages of steam generators when translated into dollars and cents have costs associated therewith which are deemed to be of the magnitude of $500 million dollars annually. The two major causes of steam generator forced outages, i.e., the two most vulnerable portions of the steam generator steam cycle, have been found to be the furnace waterwalls and the steam circuits, which represent approximately 40% and 30%, respectively, of the failures that result in the forced outage of a fossil-fired steam generator. Additionally, of the major turbine problems that are experienced at utility steam generating installations, it has been found that two-thirds of them are associated with long-term steam purity upsets. A primary cause of corrosion-induced problems in these units is related to the water and steam-side chemistry environments. Prime candidates for failure when chemistry upsets occur are both thin-walled and thick-walled components. By way of exemplification and not limitation hydrogen and caustic damage are directly related to improper boilerwater pH control, while oxygen pitting and overheating, stemming from the deposition of corrosion products, result from the inability to control oxygen and/or pH. Per unit, forced outages resulting from these and other corrosion-related failures can be quite costly, ranging from $120,000 to $720,000 per day for a 500 MW unit. Lost generating time and subsequent purchase of power for resale frequently constitute the major portions of outage costs. Consequently, minimizing or eliminating these types of occurrences can have both short-term and long-term implications for reducing overall operating and maintenance expenses.

Economics have also played a role in the increasing emphasis which is being placed on corrosion mitigation. Namely, as a result of U.S. economic conditions over the past 5–7 years, the task of forecasting load growth and electricity demand have become fret with uncertainties. This has had the effect of placing utilities in the position of having to make difficult decisions insofar as concerns arriving at a choice between the purchase of new equipment and the refurbishment of used equipment. To this end, programs have been initiated, including but not limited to life extension studies, which have for their objective the identification of the existence of deficiencies both in terms of equipment and in terms of operating practices which if modified and/or updated would have the effect of restoring unit integrity and/or of enabling operations to be maintained for extended periods of time at an acceptable level. Also, government and industry organizations in addition have instituted programs which are designed to be operative to aid in effectuating the assessment of steam generator integrity. Many of these programs are related directly to the prevention of corrosion. Furthermore, it is known that much of the funding which is being expended in order to accomplish the implementation of the recommendations that have been generated in the course of performing such programs is being spent on the replacement and/or refurbishing of corrosion-damaged components.

New and better ways are being sought to avoid past problems and to assure increased steam generator availability and reliability. To the extent that a steam generator's operating mode changes from base-loaded to cycling-operation, this task of increasing steam generator availability and reliability becomes even more difficult. As such, unless increased emphasis is placed on the steam generator's cycle chemistry environment, it can almost be guaranteed that corrosion-induced problems will occur.

The responsibility for implementing appropriate water technology practices, which can best meet the operational chemistry requirements of a given steam generating installation, rest with the operator of the steam generator. In turn the steam generator operators strive to meet these requirements by establishing monitoring, interpretation, control and trending methods which will work within the particular environment that is found to be present at a given steam generating installation. The methods which are used in this regard by the steam generator operator generally are adapted from generic guidelines which have been established by the various suppliers of the equipment which is being utilized.

By way of exemplification and not limitation, it will be assumed for purposes of the discussion which follows that the type of application which is the focus of attention is that of a high pressure steam cycle of the sort that one associates with a utility-type steam generator. In such an application, since the major sections of the cycle are coupled together the water chemistry parameters for each of the sections must be compatible. As an example, consider that the steam turbine manufacturer has set limits for constituents contained in the steam. These limits in turn function as constraints on boilerwater chemistry and also on feedwater chemistry when used as desuperheating spraywater. In addition, limits established for boilerwater chemistry function as another constraint on feedwater chemistry. It should thus be readily apparent that when contamination occurs such as from condenser leakage the entire cycle is affected. Finally, startups and load changes are also known to cause perturbations in the operational chemistry requirements of the cycle.

Continuing, there are to be found in the prior art the result of studies that have been conducted heretofore which contain findings derived from an examination of the nature of the monitoring points that have been employed for purposes of effectuating water chemistry monitoring of a high pressure steam cycle of the sort that is associated with a utility-type steam generator as well as from an examination of the frequency with which samples are normally taken at each monitoring point. Such studies encompass samples which have for water chemistry monitoring purposes been taken from the condensate/feedwater system, from the boilerwater and from the steam. With respect to the examination of these samples, the parameters that have been analyzed include pH, specific and cation conductivity, oxygen, hydrazine, silica, sodium, phosphate, chloride, iron and copper. The findings of these studies further reveal that sampling frequency varies on the one hand from continuous monitoring to on the other hand grab samples taken on the order of four times a year.

A detailed list of guidelines for monitoring and controlling steam cycle water chemistry has been compiled by one of the industry organizations. Such guidelines will undoubtedly serve as an excellent reference for steam generator operators. That is, the steam generator operators will be able to utilize these guidelines for purposes of developing a plan that has been customized to meet the requirements of their particular steam generating facility. It is known that at present not many steam generating installations utilize the full complement of possible monitoring points that are available. In addition, it is known that at not many steam generating installations are samples taken with the frequency that it is believed they should be. To this end, the present practice is to select for monitoring one or more key parameters which are perceived to be sensitive indicators of the steam cycle contamination, and to effect the monitoring thereof through the use of strip chart recorders and alarms which are found located in the control room at the steam generating installation. Other information is collected on log sheets which are reviewed periodically in order to detect trends and/or to assist in the identification of problem areas. The information which is compiled from such sources can in turn then be utilized for purposes of determining what, if any, control actions need to be taken. The actual implementation of such control actions will be effected, depending on a consideration of factors such as system preferences and shift coverage, either by the operators or by the chemistry laboratory technicians. Normally, such control actions are based on written instructions and/or consultation with the chemist who is assigned to the steam generating facility in question. Unfortunately, however, the task of establishing proper control over steam cycle chemistry is becoming more difficult both as the impact of trace contamination on the equipment being employed in the steam cycle becomes clearer, and as improvements in analytical measurements permit the detection of sub-part per billion concentrations of contaminants.

For purposes of accomplishing the monitoring function as well as for purposes of presenting the information derived from such monitoring, the trend in the case of steam cycle chemistry as in the case of many other things these days is toward computerization. Computerization as referred to herein is meant to refer to the use of mainframe as well as the use of desk top computers. By using computers, it is possible to gain rapid access to large amounts of chemistry data while at the same time permitting this data to be presented in an easy-to-understand format.

From the foregoing discussion it can, therefore, be clearly seen that the chemistry personnel at a steam generating installation face a difficult task in having to first assimilate a large body of data and then in having to draw conclusions on a real-time basis from this large body of data. Further, it is a requirement of these chemistry personnel that they possess an understanding of long-term trends and system performance so that they are in a position to meaningfully interpret this large body of data. For purposes of controlling both the short-term and the long-term mechanisms which can cause corrosion damage in a steam generating steam cycle it is necessary that the factors enumerated above be considered. To this end, a need has been evidenced in the prior art for a new and improved method for determining the existence of phosphate hideout in a steam generating steam cycle such that the nature of the impact of phosphate hideout on pH and the $PO_4$ concentration in the boilerwater of the steam generating steam cycle can be ascertained.

It is, therefore, an object of the present invention to provide a new and improved method for determining the existence of phosphate hideout in a steam generating steam cycle.

It is another object of the present invention to provide such a method whereby in accord therewith from the concentration of Na and $PO_4$ that is provided to the steam generating steam cycle there is determined what the input of Na and $PO_4$ to the steam generating steam cycle is.

It is still another object of the present invention to provide such a method whereby in accord therewith there is determined what the output of Na and $PO_4$ resulting from blowdown is from the steam generating steam cycle.

A further object of the present invention is to provide such a method whereby in accord therewith there is determined what amount of Na and $PO_4$ is consumed in the steam generating steam cycle due to contamination.

A still further object of the present invention is to provide such a method whereby in accord therewith there is determined the change in the amount of $PO_4$ that is solubilized in the boilerwater of the steam generating steam cycle.

A yet still further object of the present invention is to provide such a method whereby in accord therewith by adding together the output of $PO_4$ due to blowdown from the steam generating steam cycle and the amount of $PO_4$ that is consumed in the steam generating steam cycle due to contamination and the change in the amount of $PO_4$ that is solubilized in the boilerwater of the steam generating steam cycle there is determined what the loss of $PO_4$ from the steam generating steam cycle is.

Yet another object of the present invention is to provide such a method whereby in accord therewith as a result of subtracting from the input of $PO_4$ to the steam generating steam cycle the loss of $PO_4$ from the steam generating steam cycle there is determined whether there exists phosphate hideout and, if so, there is also determined what the magnitude of the phosphate hideout is as well as what impact the phosphate hideout will have on the pH of and the $PO_4$ concentration in the boilerwater of the steam generating steam cycle.

Yet still another object of the present invention is to provide such a method for determining the existence of phosphate hideout in a steam generating steam cycle that is advantageously characterized by the relative ease with which the subject method can be practiced as well as by the relative inexpensiveness to do so.

SUMMARY OF THE INVENTION

In accordance with the present invention there is provided a method for determining the existence of phosphate hideout in a steam generating steam cycle so that the nature of the impact of the phosphate hideout on pH and the $PO_4$ concentration in the boilerwater of the steam generating steam cycle can be ascertained. The subject method includes the steps of determining from the concentration of Na and $PO_4$ that is provided to the steam generating steam cycle the input of Na and $PO_4$ to the steam generating steam cycle, determining the output from the steam generating steam cycle of Na and $PO_4$ that results from blowdown, determining the amount of Na and $PO_4$ that is consumed in the steam generating steam cycle due to contamination, determining the change in the amount of $PO_4$ that is solubilized in the boilerwater of the steam generating steam cycle, determining the loss of $PO_4$ from the steam generating steam cycle by adding together the output of $PO_4$ from the steam generating steam cycle and the amount of $PO_4$ that is consumed in the steam generating steam cycle due to contamination and the change in the amount of $PO_4$ that is solubilized in the boilerwater of the steam generating steam cycle, and thereafter determining as a result of subtracting from the input of $PO_4$ to the steam generating steam cycle the loss of $PO_4$ from the steam generating steam cycle whether there exists phosphate hideout and, if so, what the magnitude of the phosphate hideout is as well as what impact the phosphate hideout will have on the pH of and the $PO_4$ concentration in the boilerwater of the steam generating steam cycle.

DESCRIPTION OF A PREFERRED EMBODIMENT

Figure 1:
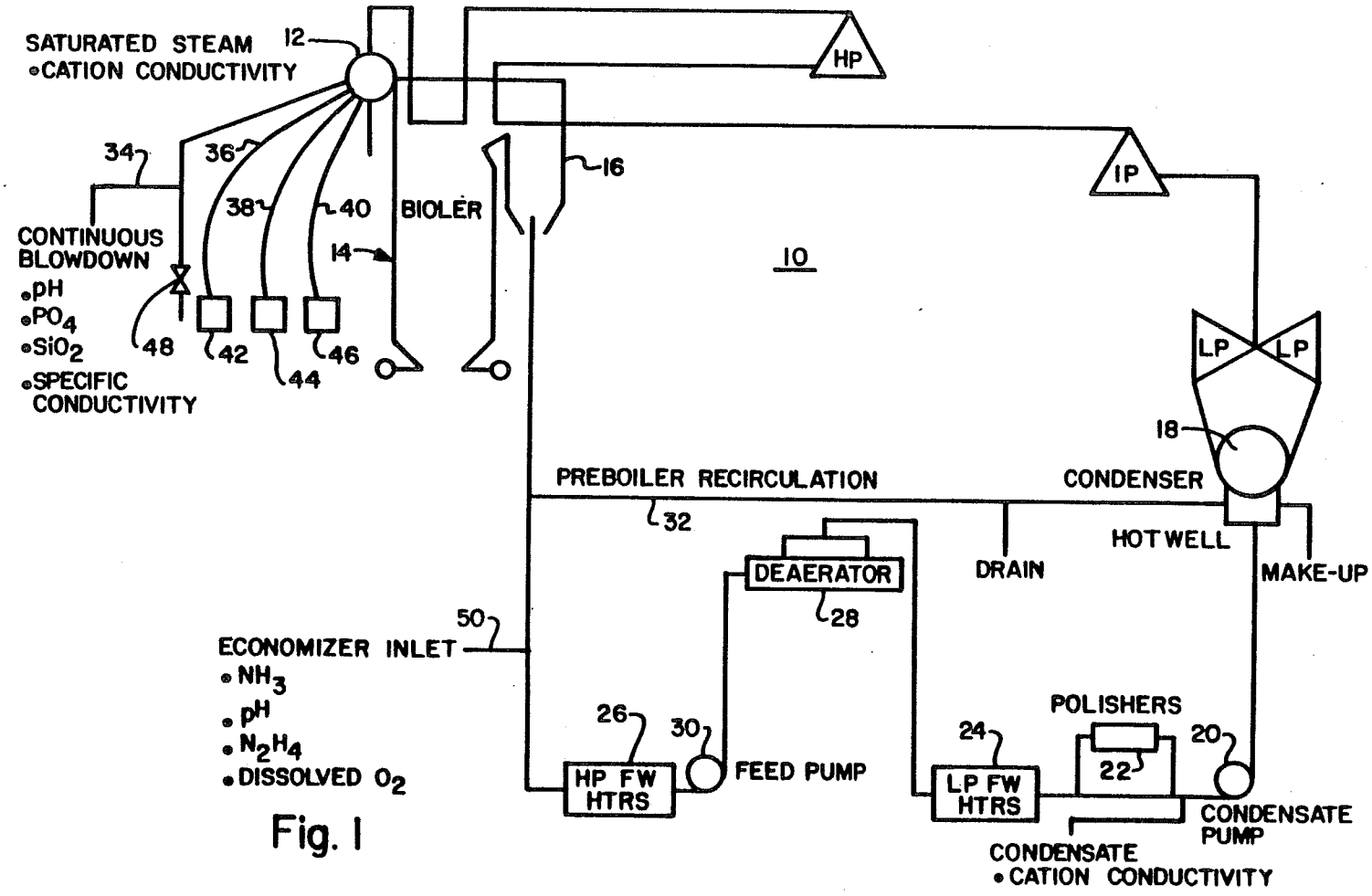
FIG. 1 is a schematic representation of the major components that are employed in a steam generating steam cycle of the type with which the method for determining the existence of phosphate hideout in a steam generating steam cycle so that the nature of the impact of the phosphate hideout on pH and the $PO_4$ concentration in the boilerwater of the steam generating steam cycle can be ascertained is, in accordance with the present invention, designed to be utilized.

Referring now to the drawing and more particularly to FIG. 1 thereof, there is depicted therein a schematic representation of a typical high pressure utility steam cycle, the latter being denoted therein generally by the reference numeral 10, with which the method for determining the existence of phosphate hideout in a steam generating steam cycle so that the nature of the impact of the phosphate hideout on pH and the $PO_4$ concentration in the boilerwater of the steam generating steam cycle can be ascertained is, in accordance with the present invention, particularly suited to be utilized. Inasmuch as the nature of the construction and the mode of operation of a high pressure utility steam cycle, such as the high pressure utility steam cycle 10 which is illustrated schematically in FIG. 1 of the drawing, is well-known to those skilled in the art, it is, therefore, not deemed to be necessary to set forth herein a detailed description of the high pressure utility steam cycle 10 shown in FIG. 1. Rather, it is deemed sufficient for purposes of acquiring an understanding of a high pressure utility steam cycle with which the method for determining the existence of phosphate hideout in a steam generating steam cycle so that the nature of the impact of the phosphate hideout on pH and $PO_4$ concentration in the boilerwater of the steam generating steam cycle can be ascertained is, in accordance with the present invention, capable of being utilized that mention be had herein merely to those major components of the high pressure utility steam cycle 10 with which an interaction is had in the course of practicing the method for determining the existence of phosphate hideout in a steam generating steam cycle. For a more detailed description of the nature of the construction and the mode of operation of the components of the high pressure utility steam cycle 10 reference may be had to the prior art.

Thus, referring again to FIG. 1 of the drawing, in accord with the illustration therein of the high pressure utility steam cycle 10 the major components thereof encompass a steam drum shown at 12, a boiler denoted generally by the reference numeral 14, an economizer identified by the reference numeral 16, a condenser illustrated at 18, a condensate pump seen at 20, polishers depicted at 22, low pressure feedwater heaters and high pressure feedwater heaters shown, respectively, at 24 and 26, a deaerator illustrated at 28, and a feed pump identified by the numeral 30. All of the components enumerated above that are encompassed in the high pressure utility steam cycle 10 as depicted in FIG. 1 of the drawing in a manner well-known to those skilled in the art are suitably interconnected in fluid flow relation one with another. In addition, as will be readily apparent from FIG. 1 an interconnection is had between the condenser 18 and the economizer 16 by means of the line schematically illustrated in FIG. 1 that bears the designation "PREBOILER RECIRCULATION" and that is denoted by the reference numeral 32.

The practice in accordance with the present invention of the method for determining the existence of phosphate hideout in a steam generating steam cycle so that the nature of the impact of the phosphate hideout on pH and the $PO_4$ concentration in the boilerwater of the steam generating steam cycle can be ascertained requires that certain data be provided. More specifically, there exists a requirement in connection with the practice of the subject method that there be provided data which pertains to the actual values for the pH and the $PO_4$ concentration in the boilerwater and the ammonia concentration in the feedwater of the steam generating steam cycle. With reference by way of exemplification and not limitation to the high pressure utility steam cycle 10 depicted in FIG. 1 of the drawing, such data pertaining to the actual values of pH, $PO_4$ and $NH_3$ is obtained from a monitoring of the water chemistry of the steam generating steam cycle 10. A system suitable for use for such a purpose forms the subject matter of co-pending U.S. patent aplication, Ser. No. 925,936, which is entitled "Intelligent Chemistry Management System" and the inventors of which are Ronald J. Barto, Frank Gabrielli and Nancy C. Mohn. In accordance with this system, samples are taken of the water chemistry of the steam generating steam cycle 10 by means of continuous analyzers, and it is from these samples that the needed information is obtained. To this end, for purposes of generating the required data relating to the actual values for the pH, $PO_4$ and $NH_3$ of the steam generating steam cycle 10 the samples are obtained in the case of pH and $PO_4$ from the sample source which is to be found identified by the reference numeral 34 in FIG. 1 of the drawing, and in the case of $NH_3$ from the sample source which is to be found identified by the reference numeral 50 in FIG. 1 of the drawing. Although the monitoring of the pH, $PO_4$ and $NH_3$ of the steam generating steam cycle 10 is preferably accomplished through the use of the monitoring, diagnosing and controlling system which forms the subject matter of co-pending U.S. patent application, Ser. No. 925,936, it is to be understood that another system could be utilized for this purpose without departing from the essence of the present invention so long as actual values for the pH, $PO_4$ and $NH_3$ of the steam generating steam cycle 10 could be obtained through the use of such another system.

Continuing, it is well-known in the prior art to employ the pumps with which a steam generating installation of conventional construction commonly is suitably provided for purposes of accomplishing chemical additions to a steam generating steam cycle of the type depicted at 10 in FIG. 1. More specifically, it is known for those applications wherein the chemical additions contemplated involve the addition of three chemicals, i.e., trisodium phosphate, disodium phosphate and monosodium phosphate, to employ at least three pumps, i.e., at least one pump for each chemical, to effect the addition of the aforereferenced chemicals to the water chemistry of the steam generating steam cycle 10.

For purposes of the discussion that follows, it will be assumed that the chemical additions to which the steam generating steam cycle 10 depicted in FIG. 1 of the drawing is subjected during the course of the operation thereof involve the addition of the three chemicals enumerated above, i.e., trisodium phosphate, disodium phosphate and monosodium phosphate. To this end, under the action of these pumps, the chemicals, i.e., trisodium phosphate, disodium phosphate and monosodium phosphate, are designed, as depicted schematically in FIG. 1 of the drawing, to be introduced into the steam generating steam cycle 10 through the steam drum 12. That is, to the extent required the trisodium phosphate, the disodium phosphate and the monosodium phosphate are made to enter the steam drum 12, i.e., are added to the water chemistry of the steam generating steam cycle 10, by means of the lines shown schematically in FIG. 1 wherein the line for trisodium phosphate, the line for disodium phosphate and the line for monosodium phosphate are identified by the reference numerals 36, 38 and 40, respectively. Each of the lines 36,38 and 40 in turn has one of its ends connected in fluid relation with the steam drum 12 and the other of its ends connected in fluid flow relation to one of the pumps, identified in FIG. 1 by the reference numerals 42, 44 and 46, with which in known fashion the steam generating installation to which the steam generating steam cycle 10 applies is suitably provided.

Notwithstanding the fact that in accord with the illustration of the steam generating steam cycle 10 that is depicted in FIG. 1 of the drawing the nature of the chemical addition which takes place involves three chemicals, i.e., trisodium phosphate, disodium phosphate and monosodium phosphate, it is to be understood that a two pump system could equally well be utilized with a steam generating steam cycle of the type depicted at 10 in FIG. 1 of the drawing without departing from the essence of the present invention. The mode of operation of such a two pump system is predicated upon the utilization of equimolar quantities of trisodium phosphate and monosodium phosphate to provide the requisite quantity of disodium phosphate. Namely, in accord therewith rather than employing three pumps, i.e., the trisodium phosphate pump 42, the disodium phosphate pump 44 and the monosodium phosphate pump 46, only two pumps would be employed, i.e., the trisodium phosphate pump 42 and the monosodium phosphate pump 46, in order to provide the equimolar quantities of trisodium phosphate and monosodium phosphate that are required in order to supply the desired quantity of disodium phosphate.

A mention is also had here of the fact that the steam generating steam cycle 10 as depicted in FIG. 1 of the drawing includes in addition a blowdown valve, the latter being identified in FIG. 1 by the reference numeral 48. It is through the manipulation of this blowdown valve 48 that control is exercised over the blowdown flowrate in the steam generating steam cycle 10.

Returning to the description of the method for determining the existence of phosphate hideout in the steam generating steam cycle 10, which forms the subject matter of the present invention, one step in the practice thereof in accord with the best mode embodiment of the invention is that of determining the input of Na and $PO_4$ to the steam generating steam cycle 10 based on the concentrations of Na and $PO_4$ that are being provided to the steam generating steam cycle 10. Although not depicted in FIG. 1 of the drawing in the interest of maintaining clarity of illustration therein, it is to be understood that each of the pumps 42, 44 and 46 is preferably connected in fluid flow relation with a suitable batch additive tank. Each of these batch additive tanks (not shown) in turn contains concentrations of the aforementioned constituents: namely, that of Na and $PO_4$.

In order to effect a determination of the input of Na and $PO_4$ to the steam generating steam cycle 10 based on the concentrations of Na and $PO_4$ that are provided to the steam generating steam cycle 10, there is a need to take into consideration the following factors. First, the density of each batch of additive, as contained in each of the batch additive tanks (not shown), must be established. Secondly, there is a need to determine the concentration of Na and the concentration of $PO_4$, each measured in parts per million (ppm), that are present in each batch additive tank. Thirdly, the period during which the additive is being pumped at a given flowrate by the corresponding one of the pumps 42, 44 and 46 from the corresponding batch additive tank (not shown) must be established. This is done by establishing the time that elapses between changes in pump output. Fourthly, there is a need to establish the flowrate at which the additive is being pumped to the steam drum 12 from the corresponding batch additive tank (not shown) by means of the corresponding one of the pumps 42, 44 and 46. It is important to note here that insofar as the foregoing procedure is concerned there is a need to obtain three sets of data; namely, one set of data for each of the three chemical additives, i.e., one set of data for trisodium phosphate, one set of data for disodium phosphate and one set of data for monosodium phosphate. Finally, in determining the input of Na and $PO_4$ to the steam generating steam cycle 10 based on the concentrations of Na and $PO_4$ that are being provided to the steam generating steam cycle 10, the assumption is made that for each chemical additive each batch thereof is made up the same way each time there is need to replenish the contents of the batch additive tanks (not shown). In the event that the composition of a batch of a chemical additive should change, recognition of this fact must be taken into account when effecting, as described above, the determination of the input of Na and $PO_4$ to the steam generating steam cycle 10 based on the concentrations of Na and $PO_4$ that are provided to the steam generating steam cycle 10. To thus summarize, the determination of the input of Na and $PO_4$ to the steam generating steam cycle 10, expressed in pounds, is based on knowing the density of each batch of chemical additive that is present in the batch additive tanks (not shown), on knowing the concentration of Na and the concentration of $PO_4$ in each batch additive tank (not shown), on knowing the period of time during which each of the pumps 42, 44 and 46 is operating at a given flowrate, on knowing the flowrate at which the chemical additives are being pumped to the steam drum 12 from the batch additive tanks (not shown) by the pumps 42, 44 and 46 and by assuming that each time the contents of a batch additive tank (not shown) is replenished the composition of the batch remains the same, or in the event that a change in the composition of a batch should take place this fact is taken into consideration in the course of arriving at the determination of what the input of Na and $PO_4$ to the steam generating steam cycle 10 is.

In accord with the best mode embodiment of the invention, another step in the practice of the subject method for determining the existence of phosphate hideout in a steam generating steam cycle, such as the steam generating steam cycle 10 depicted in FIG. 1 of the drawing, is that of determining the loss from the steam generating steam cycle 10 of Na and $PO_4$ that is attributable to blowdown. For purposes of determining the loss of Na and $PO_4$ attributable to blowdown there is first a need to establish the extent to which Na and $PO_4$ are present in the blowdown. The data needed in this connection can be garnered from samples that are obtained in known fashion from a sample source, such as the sample source which is identified by the reference numeral 34 in FIG. 1 of the drawing, and to which reference has been had herein previously. Secondly, there is a need to establish the period of time during which the blowdown is operating at a given flowrate. Thirdly, there is a need to establish the blowdown flowrate. With this information in hand, it is possible to determine, i.e., calculate, the amount of Na and $PO_4$ expressed in pounds, that during a predefined period of time leaves, i.e., is lost from, the steam generating steam cycle 10 as a result of blowdown.

Yet another step in the practice of the method for determining the existence of phosphate hideout in a steam generating steam cycle, such as the steam generating steam cycle 10 depicted in FIG. 1, to which the present invention is directed, is that of determining the change in the amount of $PO_4$ that is solubilized in the boilerwater of the steam generating steam cycle 10. This determination is accomplished in the following manner. First, the amount of $PO_4$, measured in parts per million (ppm), that at a first point in time is present in the blowdown flow is established. Insofar as the data required for this purpose is concerned, such data is obtainable from samples that are taken at a suitable sample source such as the sample source, which is identified in FIG. 1 by the reference numeral 34, and to which reference has been had herein previously. Secondly, there is established the amount of $PO_4$ measured in parts per million (ppm) that at a second point in time is present in the blowdown flow. Here also, the data that is required in this connection is obtainable from samples taken from a sample source such as the sample source seen at 34 in FIG. 1 of the drawing. Thirdly, the mass of the boilerwater measured in pounds of water is established. Having established the foregoing, it is possible to determine, i.e., to calculate, therefrom the change in the amount of $PO_4$, expressed in pounds, that is solubilized in the boilerwater between the two points in time at which measurements are made of the $PO_4$ that is present in the blowdown flow.

The next step to be accomplished in the practice of the method, which forms the subject matter of the present invention, for determining the existence of phosphate hideout in a steam generating steam cycle such as the steam generating steam cycle 10 depicted in FIG. 1 of the drawing is that of determining the amount of Na and $PO_4$ that is consumed in the steam generating steam cycle 10 due to contamination. The manner in which this determination is accomplished is as follows. First, based on an analysis of the cooling water there is established the extent to which concentrations, measured in parts per million (ppm), are present in the cooling water of the following contaminants: Ca, Mg, Na, $SO_4$, Cl, $HCO_3$ and $SiO_2$. Secondly, there is established whether a condenser leak exists. Whether a condenser leak exists can be established in a number of ways, i.e., from measurements made of the feedwater for concentrations of at least two possible contaminants such as chloride and calcium which would be present if a condenser leak existed, or based on measuring cation conductivity in the feedwater wherein a rise in cation conductivity is assumed to be attributable to a condenser leak, or based on the analysis of the concentration of a single contaminant in the feedwater such as sodium. It is possible, based on the information derived as described above, to establish values that are reflective of the extent to which there are present concentrations of the contaminants consisting of Ca, Mg, Na, $SO_4$, Cl, $HCO_3$ and $SiO_2$. If no condenser leakage exists, these values should all be zero; if not zero, the values should be small enough to be negligible. If condenser leakage does exist, the flow rates, measured in lb-moles/hr, of the foregoing contaminants due to the condenser leak are then established. Thereafter, there needs to be established, i.e., calculated, from these values the extent to which chemical additives in the form of trisodium phosphate and monosodium phosphate are required to be provided, i.e., the amount of Na and $PO_4$ expressed in lb-moles/hr that is required to be provided to the boilerwater to compensate for the consumption thereof by the contaminants. It is then possible to establish, i.e., calculate, from the amount of Na and $PO_4$ that is required to be provided, as determined in the manner described hereinabove, what the total consumption of Na and $PO_4$, expressed in pounds, due to contamination is.

Having established based on the concentrations of Na and $PO_4$ that are provided to the steam generating steam cycle 10 what the input to the steam generating steam cycle 10 of Na and $PO_4$ is as well as having established the loss from the steam generating steam cycle 10 of Na and $PO_4$ that is attributable to blowdown and the change in the amount of $PO_4$ that is solubilized in the boilerwater of the steam generating steam cycle 10 and the amount of Na and $PO_4$ that is consumed in the steam generating steam cycle 10 due to contamination, it is now possible to determine whether there exists phosphate hideout and, if so, the magnitude thereof, in the steam generating steam cycle 10 by subtracting from the input of $PO_4$ to the steam generating steam cycle 10 the loss from the steam generating steam cycle 10 of $PO_4$ that is attributable to blowdown and to the change in soluble $PO_4$ in the boilerwater and to consumption due to contamination. The extent of the phosphate hideout expressed in pounds of $PO_4$ is then converted into parts per million (ppm) of $PO_4$ based on the mass of the boilerwater, the latter being expressed in pounds of water. Next, the calculated value of the phosphate hideout, expressed in parts per million (ppm), is compared to some previously established, i.e., predefined, percent of the maximum concentration of $PO_4$ in the boilerwater that is desirable. Based on this comparison, if it is found that the calculated value of the phosphate hideout, expressed in parts per million (ppm), is less than the aforereferenced predefined percent of the maximum concentration of $PO_4$ in the boilerwater that is desirable then the impact of the phosphate hideout on pH and the $PO_4$ concentration in the boilerwater of the steam generating steam cycle 10 is not deemed to be significant enough to warrant the need for changes to be made in the control of the pH of the boilerwater and of the $PO_4$ concentration in the boilerwater of the steam generating steam cycle 10. On the other hand, if the calculated value of the phosphate hideout expressed in parts per million (ppm) exceeds the aforereferenced predefined percent of the maximum concentration of $PO_4$ in the boilerwater that is desirable then there exists a need to address the fluctuations in pH as well as the fluctuations in $PO_4$ concentration that result from the fact that there exists phosphate hideout.

Consideration will first be had herein to the matter of fluctuations in pH that are occasioned by the fact that phosphate hideout is present. In this regard, it is essential for purposes of exercising control thereover that one be able to anticipate fluctuations in pH that are attributable to the presence of phosphate hideout. The manner in which fluctuations in pH are anticipated is as follows. First, there is a need to determine what the input of Na and $PO_4$ to the steam generating steam cycle 10 is. The manner in which this determination is made has been described in detail hereinbefore. As such, it is not deemed necessary to reiterate this description at this point. Suffice it to say, the determination of the input of Na and $PO_4$ to the steam generating steam cycle 10 is based on establishing what the amount of Na and $PO_4$, expressed in lbs/hr, is that is being supplied by the pumps 42, 44 and 46 to the steam generating steam cycle 10. Secondly, there is a need to determine what the loss, expressed in lbs/hr, is of Na and $PO_4$ due to contaminant consumption. This determination is made in the manner which has been described in detail hereinbefore. In view of the presence herein of this previous description, it is deemed to be unnecessary to repeat this description at this point. Rather, it is deemed to be sufficient to merely point out that the determination of what the loss of Na and $PO_4$ is due to contaminant comsumption is based on the establishment of the extent to which concentrations of certain contaminants are present in the cooling water. Thirdly, there is a need to determine what the loss, expressed in lbs/hr, is of Na and $PO_4$ due to blowdown. How this determination is arrived at has been explained herein previously. Therefore, it is not deemed necessary to repeat this explanation at this point. In lieu thereof, it is deemed sufficient to merely note at this point that the loss of Na and $PO_4$ due to blowdown is determined based on data which is obtained from samples taken from the sample source that is denoted by the reference numeral 34 in FIG. 1 of the drawing. Next, neglecting phosphate hideout there is a need to establish the amount, expressed in pounds, of Na and $PO_4$ that is solubilized in the boilerwater at a time $T_2$. This is accomplished in the following manner. The values for the amount, expressed in lbs/hr, of Na and $PO_4$ that is supplied in the form of input to the steam generating steam cycle 10; for the amount, expressed in lbs/hr, of Na and $PO_4$ that is lost due to contaminant consumption; and for the amount, expressed in lbs/hr, of Na and $PO_4$ that is lost due to blowdown are each integrated over a common period of time in order to convert each of these values to a value that is expressed in pounds. Then, by knowing for a time $T_1$ from samples taken from the sample source 34 what the pH of the boilerwater is and what the $PO_4$ concentration in the boilerwater is, and by knowing for this same time $T_1$ from samples taken from the sample source 50 what the $NH_3$ concentration in the feedwater is, it is possible to determine what the "apparent" Na concentration in the boilerwater is. The reason why the phrase Na concentration has been preceded by the word "apparent" is simply to call attention herein to the fact that in carrying out the method for establishing the amount of Na and $PO_4$ that is solubilized in the boilerwater at a time $T_2$ that is being described consideration is given only to the Na that is associated with sodium phosphates. To this end, the method which is now in the process of being described does not take into account Na that is associated with neutral salts such as those which may result from condenser leakage. Continuing on, following that the amount, expressed in pounds, of Na and $PO_4$, which is in the boilerwater at the time $T_1$, can be determined by multiplying the amount of Na concentration that is present in the boilerwater at the time $T_1$ by the boiler volume and by multiplying the amount of $PO_4$ concentration that is present in the boilerwater at the time $T_1$ by the boiler volume. Thus, it is now possible to establish a value for the amount, expressed in pounds, of Na that is solubilized in the boilerwater at the time $T_2$ by adding to the amount of Na which is in the boilerwater at the time $T_1$ the input of Na to the steam generating steam cycle 10 and by subtracting therefrom the amount of Na that is lost due to contaminant consumption and to blowdown. Likewise, it is now possible to establish a value for the amount, expressed in pounds, of $PO_4$ that is solubilized in the boilerwater at the time $T_2$ by adding to the amount of $PO_4$ which is in the boilerwater at the time $T_1$ the input of $PO_4$ to the steam generating steam cycle 10 and by subtracting therefrom the amount of $PO_4$ that is lost due to contaminant consumption and to blowdown. Then, by knowing for the time $T_2$ what the Na concentration in the boilerwater is and what the $PO_4$ concentration in the boilerwater is, and by knowing for this same time $T_2$ from samples taken from the sample source 50 what the $NH_3$ concentration in the feedwater is, it is possible to determine therefrom what the pH of the boilerwater should be at the time $T_2$. Since the actual value of the pH of the boilerwater at the time $T_2$ is known based on data obtained from samples taken from the sample source 34, the difference between what the value of the pH of the boilerwater should be as established in the manner described hereinbefore and what the actual value of the pH of the boilerwater is found to be at the time $T_2$ is attributed to phosphate hideout. Based on knowing this difference, it is then possible to determine the nature of the corrective action, if any, that should be taken in order to obviate the impact that the presence of phosphate hideout would otherwise have on the pH of the boilerwater of a steam generating steam cycle such as the steam generating steam cycle 10 depicted in FIG. 1 of the drawing.

Consideration will next be had of the matter of fluctuations in $PO_4$ concentration that are occasioned by the fact that phosphate hideout is present. In this regard, it is essential for purposes of exercising control thereover that one be able to anticipate fluctuations in $PO_4$ concentration that are attributable to the presence of phosphate hideout. The manner in which such fluctuations in $PO_4$ are ascertained is as follows. First, there is obtained the value, expressed in pounds per period of time, of the phosphate hideout, as established in accord with the procedure that has been described herein previously. If the value of the phosphate hideout is found to have a plus value, then this is indicative of the fact the concentration of $PO_4$ in the boilerwater is decreasing faster than anticipated. On the other hand, if the value of the phosphate hideout is found to have a minus value, then this is indicative of the fact that the concentration of $PO_4$ in the boilerwater is increasing faster than anticipated. Accordingly, as a result of establishing the nature of the fluctuations in $PO_4$ concentration in the boilerwater that are attributable to the presence of phosphate hideout, i.e., whether the presence of phosphate hideout is causing the $PO_4$ concentration in the boilerwater to increase faster than anticipated or to decrease faster than anticipated, it is possible to determine the nature of the corrective actions that should be taken, if so needed, in order to obviate the impact that the presence of phosphate hideout would otherwise have on the $PO_4$ concentration in the boilerwater of a steam generating steam cycle such as the steam generating steam cycle 10 depicted in FIG. 1 of the drawing.

Thus, in accordance with the present invention there has been provided a new and improved method for determining the existence of phosphate hideout in a steam generating steam cycle. Moreover, the method of the present invention is characterized in that in accord therewith from the concentration of Na and $PO_4$ that is provided to the steam generating steam cycle there is determined what the input of Na and $PO_4$ to the steam generating steam cycle is. In addition, in accord with the present invention a method is provided wherein there is determined what the output of Na and $PO_4$ resulting from blowdown is from the steam generating steam cycle. Further, the method of the present invention is characterized in that there is determined what amount of Na and $PO_4$ is consumed in the steam generating steam cycle due to contamination. Additionally, in accordance with the present invention a method is provided wherein there is determined the change in the amount of $PO_4$ that is solubilized in the boilerwater of the steam generating steam cycle. Also, the method of the present invention is characterized in that by adding together the output of $PO_4$ due to blowdown from the steam generating steam cycle and the amount of $PO_4$ that is consumed in the steam generating steam cycle due to contamination and the change in the amount of $PO_4$ that is solubilized in the boilerwater of the steam generating steam cycle there is determined what the loss of $PO_4$ from the steam generating steam cycle is. Furthermore, in accordance with the present invention a method is provided wherein as a result of subtracting from the input of $PO_4$ to the steam generating steam cycle the loss of $PO_4$ from the steam generating steam cycle there is determined whether there exists phosphate hideout and, if so, there is also determined what the magnitude of the phosphate hideout is as well as what impact the phosphate hideout will have on the pH of and the $PO_4$ concentration in the boilerwater of the steam generating steam cycle. Finally, the method of the present invention for determining the existence of phosphate hideout in a steam generating steam cycle is advantageously characterized by the relative ease with which the subject method can be practiced as well as by the relative inexpensiveness to do so.

While only one embodiment of our invention has been shown and described herein, it will be appreciated that modifications thereof, some of which have been alluded to hereinabove, may still be readily made thereto by those skilled in the art. We, therefore, intend by the appended claims to cover the modifications alluded to herein as well as all other modifications which fall within the true spirit and scope of our invention.

What is claimed is:

1. A method for determining the existence of phosphate hideout in a steam generating steam cycle comprising the steps of:

a. determining from the concentration of $PO_4$ that is provided to the steam generating steam cycle the input of $PO_4$ to the steam generating steam cycle;

b. determining the loss of $PO_4$ from the steam generating steam cycle that is attributable to blowdown and solubility and contamination; and c. determining whether phosphate hideout is present by comparing to the input of $PO_4$ to the steam generating steam cycle the loss of $PO_4$ from the steam generating steam cycle that is attributable to blowdown and solubility and contamination.

2. The method as set forth in claim 1 including the further step of ascertaining when phosphate hideout is present the impact thereof on the pH of the boilerwater of the steam generating steam cycle.

3. The method as set forth in claim 2 including the further step of ascertaining when phosphate hideout is present the impact thereof on the $PO_4$ concentration in the boilerwater of the steam generating steam cycle.

4. The method as set forth in claim 3 including the further step of determining from the concentration of Na that is provided to the steam generating steam cycle the input of Na to the steam generating steam cycle.

5. The method as set forth in claim 4 including the further step of determining the loss of Na from the steam generating steam cycle that is attributable to blowdown and contamination.

6. A method for determining the existence of phosphate hideout in a steam generating steam cycle comprising the steps of:

a. determining from the concentration of $PO_4$ that is provided to the steam generating steam cycle the input of $PO_4$ to the steam generating steam cycle;

b. determining the output from the steam generating steam cycle of $PO_4$ that results from blowdown;

c. determining the change in the amount of $PO_4$ that is solubilized in the boilerwater of the steam generating steam cycle;

d. determining the amount of $PO_4$ that is consumed in the steam generating steam cycle due to contamination;

e. determining the loss of $PO_4$ from the steam generating steam cycle by combining the output of $PO_4$ from the steam generating steam cycle that results from blowdown and the change in the amount of $PO_4$ that is solubilized in the boilerwater of the steam generating steam cycle and the amount of $PO_4$ that is consumed in the steam generating steam cycle due to contamination; and f. determining whether phosphate hideout is present by comparing to the input of $PO_4$ to the steam generating steam cycle the loss of $PO_4$ from the steam generating steam cycle.

7. The method as set forth in claim 6 including the further step of ascertaining when phosphate hideout is present the impact thereof on the pH of the boilerwater of the steam generating steam cycle.

8. The method as set forth in claim 7 including the further step of ascertaining when phosphate hideout is present the impact thereof on the $PO_4$ concentration in the boilerwater of the steam generating steam cycle.

9. The method as set forth in claim 8 wherein the determination of the input of $PO_4$ to the steam generating steam cycle is made based on knowing the density of each batch of chemical additive, on knowing the concentration of $PO_4$ in each batch of chemical additive, on knowing the period of time during which each of the chemical additives is supplied at a given flowrate to the steam generating steam cycle, on knowing the flowrate at which each of the chemical additives is being supplied to the steam generating steam cycle, and on knowing each time a batch of chemical additive is replenished whether the composition of the batch remains the same.

10. The method as set forth in claim 9 wherein the determination of the output from the steam generating steam cycle of $PO_4$ that results from blowdown is made based on measuring the extent to which $PO_4$ is present in the blowdown, on establishing the period of time during which the blowdown is operating at a given flowrate and on knowing the blowdown flowrate.

11. The method as set forth in claim 10 wherein the determination of the change in the amount of $PO_4$ that is solubilized in the boilerwater of the steam generating steam cycle is made based on performing a first measurement of the amount of $PO_4$ that is present in the blowdown flow, on performing a second measurement of the amount of $PO_4$ that is present in the blowdown flow, and on knowing the mass of the boilerwater.

12. The method as set forth in claim 11 wherein the determination of the amount of $PO_4$ that is consumed in the steam generating steam cycle due to contamination is made based on knowing the extent to which concentrations of contaminants are present in the cooling water, on knowing whether a condenser leak exists, and on knowing the extent to which chemical additives are required to be provided by virtue of the nature of the concentrations of contaminants that are present.

13. The method as set forth in claim 12 including the further step of determining from the concentration of Na that is provided to the steam generating steam cycle the input of Na to the steam generating steam cycle.

14. The method as set forth in claim 13 including the further step of determining the output from the steam generating steam cycle of Na that results from blowdown.

15. The method as set forth in claim 14 including the further step of determining the amount of Na that is consumed in the steam generating steam cycle due to contamination.

* * * * *